US006405617B1

(12) United States Patent
Collins

(10) Patent No.: US 6,405,617 B1
(45) Date of Patent: Jun. 18, 2002

(54) MAGNETIC HAMMER

(76) Inventor: John Collins, 2811 S. State Rd. 39, North Judson, IN (US) 46366

( * ) Notice: Subject to any disclaimer, the term of this patent is extended or adjusted under 35 U.S.C. 154(b) by 0 days.

(21) Appl. No.: 09/708,267

(22) Filed: Nov. 7, 2000

(51) Int. Cl.[7] ..... B25D 1/16
(52) U.S. Cl. ..... 81/24; 81/20; 7/146
(58) Field of Search ..... 81/20, 23, 24; 7/143, 146

(56) References Cited

U.S. PATENT DOCUMENTS

| | | | |
|---|---|---|---|
| 2,482,909 | A | 9/1949 | Hertz |
| 2,788,815 | A | 4/1957 | D'Aoust |
| 3,580,312 | A | 5/1971 | Hallock |
| 4,073,327 | A | 2/1978 | Pearson |
| 4,291,736 | A | 9/1981 | Robertson et al. |
| 4,448,230 | A | 5/1984 | Reed |
| 4,465,115 | A | 8/1984 | Palomera |
| 4,796,495 | A | 1/1989 | Schär |
| 4,890,518 | A | 1/1990 | Floyd |
| 4,944,203 | A | 7/1990 | Miller |
| 5,000,064 | A | 3/1991 | McMahon |
| 5,213,023 | A | 5/1993 | Floyd |
| 5,280,737 | A | 1/1994 | Floyd |
| 5,945,901 | A | 8/1999 | Coleman, Jr. et al. |
| 5,988,020 | A | 11/1999 | Johnson |
| 6,062,108 | A | 5/2000 | Rosero |

*Primary Examiner*—James G. Smith
(74) *Attorney, Agent, or Firm*—Brinks Hofer Gilson & Lione

(57) ABSTRACT

A magnetic hammer for use as a hammer and as an object retrieval device is disclosed. The magnetic hammer includes a hammerhead, a handle and a magnetic material. The hammerhead has a cavity therein that is formed to accept the handle. In addition, the cavity is also capable of accepting the magnetic material. The magnetic material and the handle are fixedly coupled with the hammerhead. The magnetic material is operable to attract objects placed in the proximity of the magnetic hammer.

19 Claims, 2 Drawing Sheets

MAGNETIC HAMMER

FIELD OF THE INVENTION

The present invention relates generally to hammers and, more particularly, to a magnetic hammer having object retrieval capabilities.

BACKGROUND OF THE INVENTION

Conventional hammers have existed for many years. Typically, the hammer has a hammerhead that includes a flat face for striking an object, such as, for example, nails, tacks, brads or other similar fasteners. In addition, hammerheads also typically include a body and some form of connection mechanism for mounting the body to a handle. The hammerhead may also include a portion of the body formed into a claw that may be used, for example, to remove nails from a material in which the nail has been embedded. The typical use of a hammer is for driving objects into another material by aligning the object with the material and striking the object with the flat face such that the object is driven forcefully into the material.

Some forms of hammers also include the capability to maintain the object in a predetermined position on the hammerhead. The predetermined position of the object is such that the object may be driven into a material by striking the material with that part of the hammerhead where the object is positioned. The position of the object is typically maintained on the flat face of the hammer by a socket, a recess, a magnet or other similar mechanism capable of maintaining the position of the object. The purpose of such an object positioning mechanism may be to avoid manual alignment of the object with the material prior to striking the object with the hammer. Hammers that include magnets for maintaining the position of an object may also be capable of retrieving objects attracted to magnets.

A common occurrence when using a hammer is the need to retrieve multiple objects that cannot be easily grasped with one hand, recover dropped objects or retrieve objects that are positioned beyond easy reach. To retrieve such objects, a user of a conventional hammer must usually stoop or bend to manually grasp and retrieve the objects with his hand. Prior art hammers that include magnets that may be used to retrieve objects also include a specially designed and formed hammerhead to maintain objects in a predetermined position as previously discussed.

Specially designed and formed hammerheads typically require specialized manufacturing and tooling techniques that may increase manufacturing and assembly costs. In addition, other problems with durability and general functionality may also compromise reliable operation of the hammer. Accordingly a need exists for a hammer that is functional, durable, relatively simple and economical to manufacture and assemble, and includes the capability to retrieve objects.

SUMMARY OF THE INVENTION

The present invention discloses a magnetic hammer that overcomes problems associated with the prior art. The preferred embodiments of the magnetic hammer provide the functionality of a conventional hammer with the capability to retrieve objects. In addition, the magnetic hammer may be manufactured without special machining or other complex manufacturing requirements and is relatively easy to assemble.

The magnetic hammer of one embodiment includes a hammerhead, a handle and a magnetic material. The hammerhead and handle are coupled in a conventional configuration. The hammerhead forms a body that includes a cavity that extends from the top of the hammerhead to the bottom as in conventional hammerheads. The handle includes a first end and a second end. The first end of the handle extends into the cavity and is fixedly coupled therein. The magnetic material is also fixedly positioned within the cavity by an adhesive material. The magnetic material is fixedly coupled to the hammerhead such that the magnetic material forms a portion of the top of the hammerhead.

The preferred magnetic hammer may utilize a more or less conventionally designed hammerhead and handle with the addition of the magnetic material. Accordingly, existing hammer manufacturing and assembly processes remain almost unchanged. Further, since the magnetic material is formed to fit within the cavity of a conventional hammerhead, assembly of the magnetic hammer is relatively simple and economical. These and other features and advantages of the invention will become apparent upon consideration of the following detailed description of the preferred embodiments, viewed in conjunction with the appended drawings. The foregoing discussion has been provided only by way of introduction. Nothing in this section should be taken as a limitation on the following claims, which define the scope of the invention.

DETAILED DESCRIPTION OF THE PRESENTLY PREFERRED EMBODIMENTS OF THE INVENTION

The exemplary embodiments of the invention are set forth below with reference to specific configurations, and those skilled in the art would recognize various changes and modifications could be made to the specific configurations while remaining within the scope of the claims.

Figure 1:
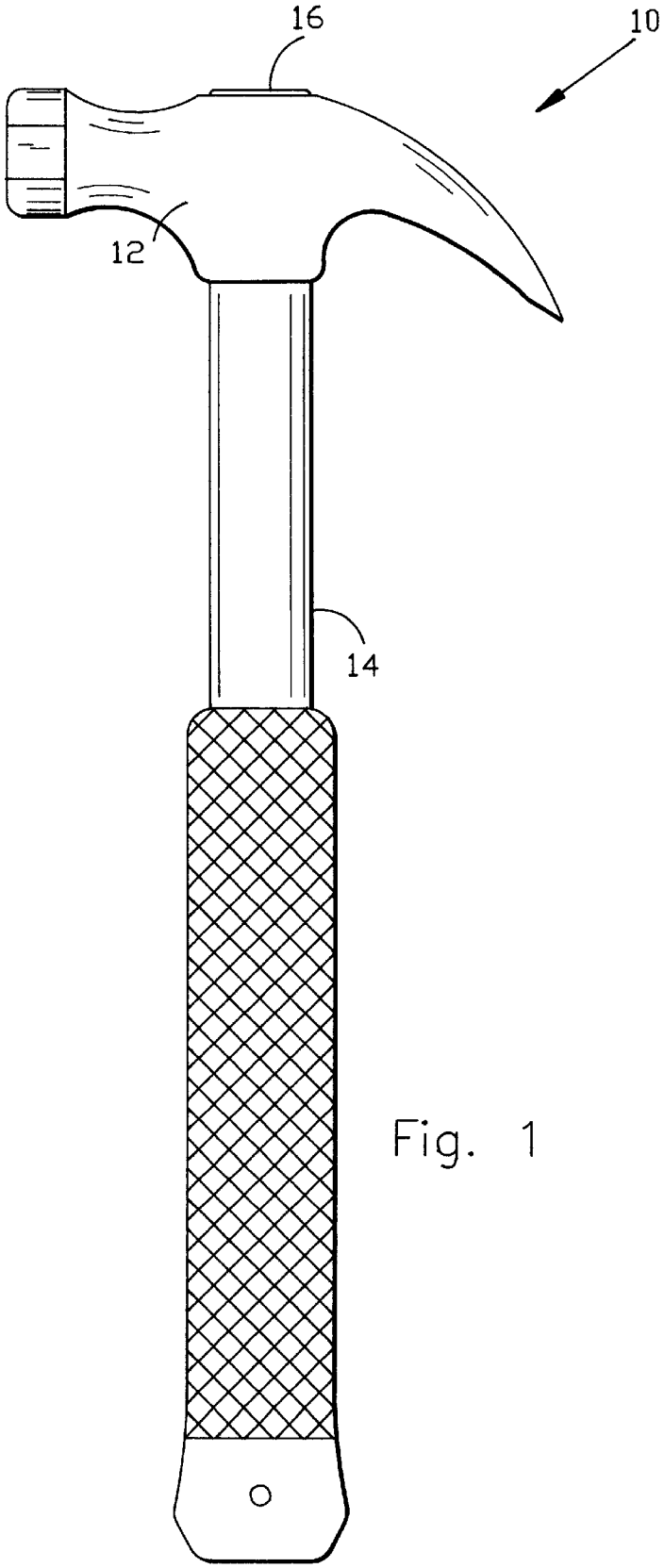
FIG. 1 is a front view of an embodiment of the magnetic hammer.

FIG. 1 is a front view of an embodiment of the magnetic hammer 10. The preferred magnetic hammer 10 includes a hammerhead 12, a handle 14 and a magnetic material 16. The hammerhead 12 is fixedly coupled to the handle 14 and the magnetic material 16 as will be hereinafter described. The hammerhead 12 and the handle 14 are of a more or less conventional design and operation with the exception of the magnetic material 16.

The addition of the magnetic material 16 to the hammerhead 12 and handle 14 provides the additional feature of a retrieval device for objects. The objects may be, metallic objects such as, for example, nails, screws, bolts, washers, wire nuts, clamps or any other object that is attracted to the magnetic material 16. Since the addition of the magnetic material 16 is accomplished without significant changes to the design or manufacture of a conventional hammerhead 12 and handle 14, the magnetic hammer 10 is economical to manufacture and assemble.

Figure 2:
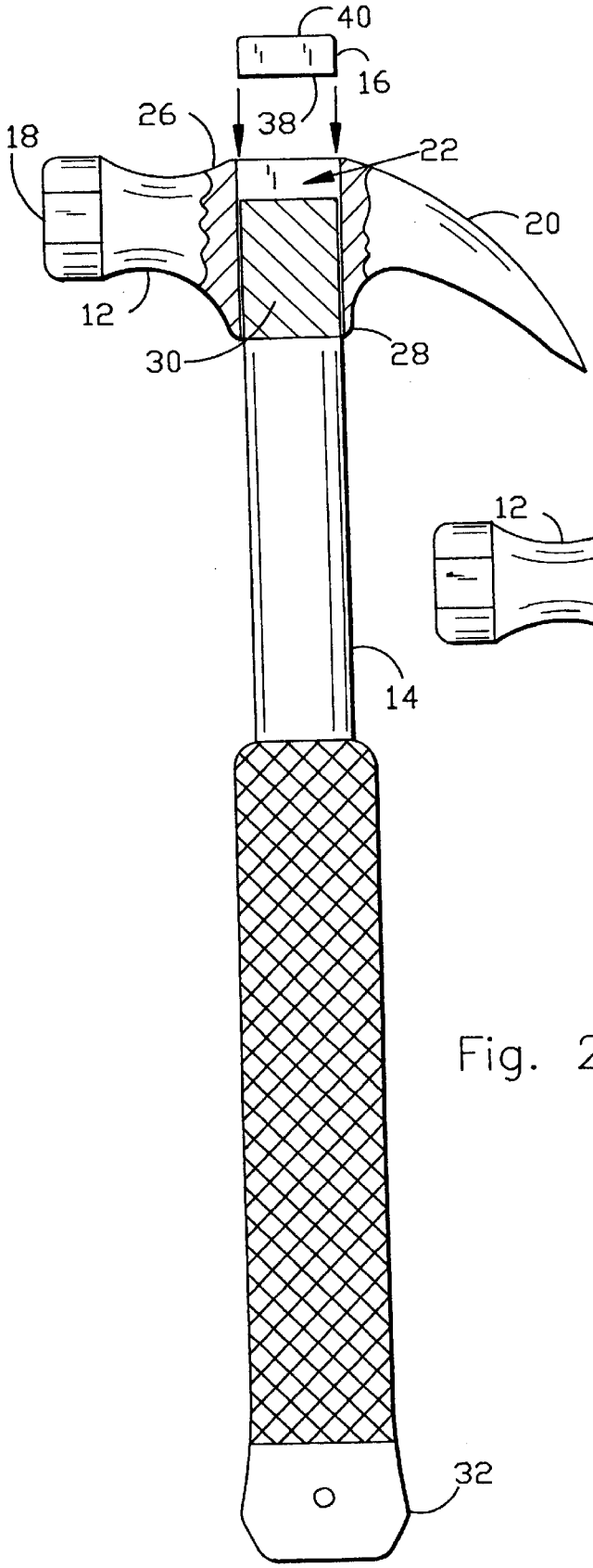
FIG. 2 is the magnetic hammer illustrated in FIG. 1 with a portion of the magnetic hammer cross-section and a magnetic material depicted as removed from the magnetic hammer.

FIG. 2 is a front view of the magnetic hammer 10 illustrated in FIG. 1 with a portion of the hammerhead 12 and the handle 14 cross-sectioned away for illustrative purposes. In addition, the magnetic material 16 is illustratively depicted as removed from the magnetic hammer 10. The hammerhead 12 of one embodiment includes a face portion 18, a claw portion 20 and a cavity 22.

The hammerhead 12 forms a body that may be any rigid material with sufficient hardness and durability to perform a hammering function. The preferred hammerhead 12 is ferrous material and may, for example, be formed by conventional forging or casting techniques. The face portion 18 forms a flat surface that is typically the contact area with objects that may be struck with the magnetic hammer 10. The claw portion 20 may be formed opposite the face portion 18. The claw portion 20 is adapted to withdraw objects, such as nails, from a nailed material (not shown) in a well-known manner.

The cavity 22 is formed by the interior surface of the body of the hammerhead 12. The cavity 22 is a passageway that longitudinally extends from a top 26 to a bottom 28 of the hammerhead 12. The cavity is formed to accept the handle 14 such that the handle 14 extends from the bottom 24 of the hammerhead 12 as illustrated. Those skilled in the art would recognize that many other conventional configurations of the hammerhead 12 may be used in conjunction with the present invention.

The handle 14 may be formed of wood, plastic, fiberglass, metal or any other rigid material capable of withstanding the force of repeatedly striking an object with the hammerhead 12. The handle 14 is an elongated member with a first end 30 and a second end 32. A portion of the handle 14 that includes the first end 30 is fixedly coupled with the hammerhead 12 by insertion into the cavity 22. The first end 30 may be fixedly coupled with the hammerhead 12 by press fit, welding, gluing, fasteners or other similar fastening mechanism. In the preferred embodiment, the handle 14 is press fit into the cavity to provide a friction fit and glued with adhesive material such as, for example, epoxy. The magnetic material 16 is also fixedly coupled with the hammerhead 12.

The magnetic material 16 may be formed of any permanent magnet material that includes sufficient magnetic strength to attract and retain objects. The preferred embodiment of the magnetic material 16 is a rare earth magnet formed of Neodymium-Iron-Boron (Nd—Fe—B) that includes a protective coating of nickel or zinc. The magnetic material 16 is positioned within the cavity 22 of the hammerhead 12 adjacent to the first end 30 of the handle 14.

Figure 3:
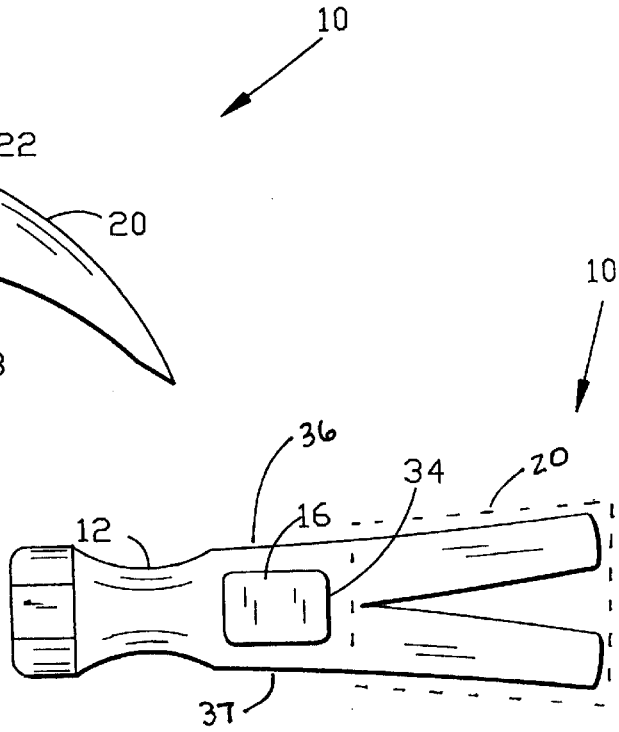
FIG. 3 illustrates a top view of the magnetic hammer depicted in FIG. 1.

FIG. 3 is a top view of the magnetic hammer 10 illustrated in FIG. 1 to further illustrate the position of the magnetic material 16. As illustrated, the magnetic material 16 is positioned within an aperture 34 that is an entrance to the cavity 22 within the hammerhead 12. The hammerhead 12 circumferentially surrounds the magnetic material 16 to form a continuous flat surface as illustrated. The continuous flat surface 1.5 is formed by a first side 36 of the hammerhead 12, a second side 37 of the hammerhead 12, a portion of the top 26 (FIG. 2) between the face portion 18 and the claw portion 20 and the magnetic material 16. The magnetic material 16 may be formed to fit within the aperture 34 and extend a predetermined distance into the cavity 22. As illustrated in FIG. 3, the magnetic material may be formed to substantially fill the aperture such that a relatively large flat surface is presented to metallic objects positioned adjacent to the top 26 (FIG. 2). The magnetic material 16 of one embodiment is formed in a rectangular shaped cube with dimensions of about 0.750 inches long, 0.60 inches wide and 0.20 inches deep.

Referring again to FIG. 2, a bottom surface 38 of the magnetic material 16 is, positioned adjacent the first end 30 of the handle 14. The first end 30 of the handle 14 extends into the cavity 22 within the hammerhead 12 a predetermined distance. The remaining space in the cavity 22 allows the extension of the magnetic material 16 into the cavity 22. The magnetic material 16 extends into the cavity 22 such that a top surface 40 of the magnetic material 16 forms a portion of the continuous flat surface on the top 26 of the hammerhead 12. Those skilled in the art would recognize that the space consumed by the magnetic material 16 exists in the coupling of a conventional hammerhead 12 and handle 14 and is typically consumed by adhesive material such as, for example, epoxy.

In the preferred embodiment, adhesive material (not shown) is applied in the cavity 22 to fixedly couple the magnetic material 16 to the hammerhead 12. The combination of the adhesive material and the top surface 40 of the magnetic material 16 effectively seal the cavity 22 at the top 26 of the hammerhead 12. As previously discussed, the adhesive material also fixedly couples the handle 14 to the hammerhead 12.

The magnetic hammer 10 of the presently preferred embodiment provides the functionality of a conventional hammer and the added capability of a material retrieval feature. The retrieval feature allows the recovery of objects by a user of the magnetic hammer without the repeated bending and stooping that would otherwise be necessary for manual retrieval of the objects. As such, users of the magnetic hammer 10 with physical disabilities aggravated by bending and stooping may experience less discomfort. Since the magnetic hammer 10 is constructed with a hammerhead 12 and a handle 14 that are more or less of conventional design, specialized manufacturing and assembly procedures are unnecessary. Further, the addition of the magnetic material 16 does not affect the design of the hammerhead 12, therefore the reliability and functionality of the magnetic hammer 10 is maintained with the addition of the magnetic material 16.

While the present invention has been described with reference to specific exemplary embodiments, it will be evident that various modifications and changes may be made to these embodiments without departing from the spirit and scope of the invention. It is the following claims, including all equivalents, that are intended to define the spirit and scope of the invention.

What is claimed is:

1. A magnetic hammer for retrieving metallic objects, the magnetic hammer comprising:

a handle;

a hammerhead with a cavity formed therein, the hammerhead comprising a face portion, a claw portion, a top and a bottom, the top comprising a continuous flat surface disposed between the face portion and the claw portion, the hammerhead fixedly coupled with the handle, wherein a portion of the handle extends a predetermined distance into the cavity from the bottom to fill a portion of the cavity; and a magnetic material fixedly positioned within the cavity at the top of the hammerhead, the magnetic material forming a portion of the continuous flat surface, the magnetic material extending from the top into the cavity to occupy the remaining portion of the cavity and lie adjacent the handle.

2. The magnetic hammer of claim 1 wherein the magnetic material is fixedly positioned in the cavity by an adhesive material such that metallic objects are attracted to the continuous flat surface.

3. The magnetic hammer of claim 1 wherein the magnetic material comprises a top surface and a bottom surface, the top surface forming the portion of the continuous flat surface, the bottom surface positioned adjacent the handle within the cavity.

4. The magnetic hammer of claim 1 wherein the magnetic material is formed in a cube, the cavity formed to accommodate the cube and the handle.

5. The magnetic hammer of claim 1 wherein the magnetic material comprises Neodymium-Iron-Boron.

6. The magnetic hammer of claim 1 wherein the hammerhead comprises a ferrous material.

7. The magnetic hammer of claim 1 wherein the handle is fixedly held in the cavity by friction fit and an adhesive material.

8. A magnetic hammer for retrieving metallic objects, the magnetic hammer comprising:

an elongated handle having a first end and a second end;

a body comprising a top, a bottom and a cavity, the cavity forming a continuous passageway from the top to the bottom of the body, the body fixedly coupled to the first end of the handle such that the first end of the handle is disposed in the cavity and extends away from the bottom of the body;

an adhesive material disposed within the cavity; and a magnetic material fixedly coupled to the body by the adhesive material, the magnetic material disposed within an aperture forming an entrance to the cavity in the top of the body, the adhesive material and the magnetic material operable to fill the aperture and seal the cavity at the top of the body, the magnetic material circumferentially surrounded by the body such that the magnetic material and the top of the body form a continuous flat surface operable to attract metallic objects.

9. The magnetic hammer of claim 8 wherein the magnetic material is positioned to extend into the cavity within the body and lie adjacent the first end of the handle.

10. The magnetic hammer of claim 8 wherein the magnetic material comprises Neodymium-Iron-Boron.

11. The magnetic hammer of claim 8 wherein the body comprises a ferrous material.

12. The magnetic hammer of claim 8 wherein the body further comprises a first side and a second side, the first and second sides forming a portion of the continuous flat surface.

13. The magnetic hammer of claim 8 wherein the first end of the handle is fixedly coupled with the body by friction fit and the adhesive material.

14. A magnetic hammer, comprising:

an elongated handle having a first end and a second end;

a hammerhead having a top and a bottom that is coupled with the elongated handle, wherein the hammerhead includes a cavity that the first end of the elongated handle is fixedly positioned within such that the elongated handle extends away from the bottom of the hammerhead to the second end; and a magnetic material forming a rectangular shaped cube having a top surface and a bottom surface that is fixedly coupled to the hammerhead, wherein the bottom surface is positioned within the cavity adjacent the first end of the elongated handle and the top surface forms a portion of the top of the hammerhead.

15. The magnetic hammer of claim 14 wherein the magnetic material is fixedly coupled to the hammerhead by adhesive material.

16. The magnetic hammer of claim 15 wherein the magnetic material and the adhesive material form a seal that fills an aperture that comprises an entrance to the cavity.

17. The magnetic hammer of claim 14 wherein the magnetic material comprises Neodymium-Iron-Boron.

18. The magnetic hammer of claim 14 wherein the rectangular shaped cube that forms the magnetic material is about 0.75 inches long, 0.60 inches wide and 0.20 inches deep.

19. The magnetic hammer of claim 14 wherein the elongated handle longitudinally extends into the cavity a predetermined distance to fill a portion of the cavity such that the remaining space in the cavity accommodates the magnetic material.

* * * * *